United States Patent [19]

Heirich

[11] 4,091,588

[45] May 30, 1978

[54] SPRING ACTION PANEL INTERLOCK

[76] Inventor: William C. Heirich, 2912 Wauhilah Dr., Muskogee, Okla. 74401

[21] Appl. No.: 798,104

[22] Filed: May 18, 1977

[51] Int. Cl.[2] ..... E04B 5/52

[52] U.S. Cl. ..... 52/478; 52/522; 52/542; 52/588

[58] Field of Search ..... 52/519, 520, 522, 529, 52/537, 519, 542, 588, 478, 543, 521, 530, 531

[56] References Cited

U.S. PATENT DOCUMENTS

| | | | |
|---|---|---|---|
| 1,706,924 | 3/1929 | Kane | 52/542 X |
| 3,394,524 | 7/1968 | Howarth | 52/588 |
| 3,481,094 | 12/1969 | Taylor | 52/522 X |
| 3,568,388 | 3/1971 | Flachbarth et al. | 52/588 |
| 3,603,057 | 9/1971 | Curran | 52/478 |
| 3,733,767 | 5/1973 | Craik | 52/588 X |

FOREIGN PATENT DOCUMENTS

| | | | |
|---|---|---|---|
| 284,855 | 10/1966 | Australia | 52/588 |

*Primary Examiner*—Ernest R. Purser
*Assistant Examiner*—Carl D. Friedman
*Attorney, Agent, or Firm*—Staas & Halsey

[57] ABSTRACT

A paneling system having a supporting member and a plurality of panels each of which is provided at the ends thereof with interlocking flanges, the interlocking flange located at one end of the panel having a portion extending from the panel to the supporting member engaging same and thereafter extending away from the supporting member terminating in an end that is positioned in spaced relationship from the remainder of the flange, a fastener securing the flange to the supporting member, and wherein the interlocking flange at the other end of the panel has a portion extending from the panel which engages only a part of the corresponding portion of the other interlocking flange extending to a point near the supporting member and thereafter backwardly toward the end of the other interlocking flange terminating in an end which engages the end of the other interlocking flange.

14 Claims, 5 Drawing Figures

SPRING ACTION PANEL INTERLOCK

BACKGROUND AND SUMMARY OF THE INVENTION

The present invention relates to a system for locking adjacently positioned panels together and for suspending the assembled panels from a supporting member. A wide variety of techniques have been used in the past to install panels to overhead supporting structure, including by way of example, panels which are provided with locking flanges configured such that after the flanges of adjacent panels are aligned one of the panels is rotated relative to the other to lock the panels in place. Clips extending downwardly from the supporting member have sometimes been used to secure the adjacent flanges of the panels to the supporting member. In addition to the foregoing, the panels are sometimes fastened directly to the overhead supporting structure with the use of self-drilling fasteners. With these and other known panel locking systems in mind it is apparent that with the spring action panel interlock of the present invention it is possible to accomplish the following objectives believed to be heretofore unavailable. With the present invention, adjacent panels may be interlocked with only "linear" motion by merely urging the male flange of one panel into engagement within the female flange of an adjacent panel. Thus, the necessity of having to swing one panel over the other, or to use clips, or to pre-drill the support before beginning to assemble the panels, is eliminated. Moreover, with the present invention simple screwtype fasteners may be used to secure the panels to the overhead supporting structure from a position below the structure thus avoiding the necessity of having to work on top of the supporting structure. In addition, with the panel interlock of the present invention only very slight pressure by the hand is necessary to "snap" the interlocking flanges of adjacent panels together. But once assembled, the panels cannot unlock by reverse action under downward pressure since increasing the load on the panels results only in forcing the interlocking flanges into tighter engagement. This procedure of interlocking with only slight pressure while providing a fail-safe system against unlocking is applicable over a wide range of dimensional tolerances thus avoiding the necessity of precise orientation of the components of the interlocking system. Still further, the snap-action panel interlock of the present invention is suitable for use with a reinforcing member positioned between the interlocking flanges of adjacent panels for increasing substantially both the load bearing and spanning capability of the assembled panel system.

The foregoing advantages are accomplished with the spring action panel interlock of the present invention which features a first interlocking female flange of one panel that has a portion which extends from the panel to the supporting member, another portion that extends along the supporting member engaging same such that a fastener can secure this portion directly to the supporting member, and another portion that extends away from the supporting member terminating in an end which is spaced from the other portions of the flange and which is provided with a lip. The other interlocking male flange of an adjacent panel has a portion which extends from the panel and which engages only a part of the corresponding portion of the other flange so as to reduce the friction therebetween permitting longitudinal sliding of adjacent panels, and another portion which extends diagonally backwardly terminating in an end which engages the lip of the other flange. Under increased loading, the interlocked panels are forced into even tighter relationship as a result of the diagonally positioned portion of the male flange being forced into a position generally perpendicular to the remainder of the flange thus causing the end of the male flange to force the lip of the female flange outwardly.

DESCRIPTION OF THE PREFERRED EMBODIMENT

Figure 1:
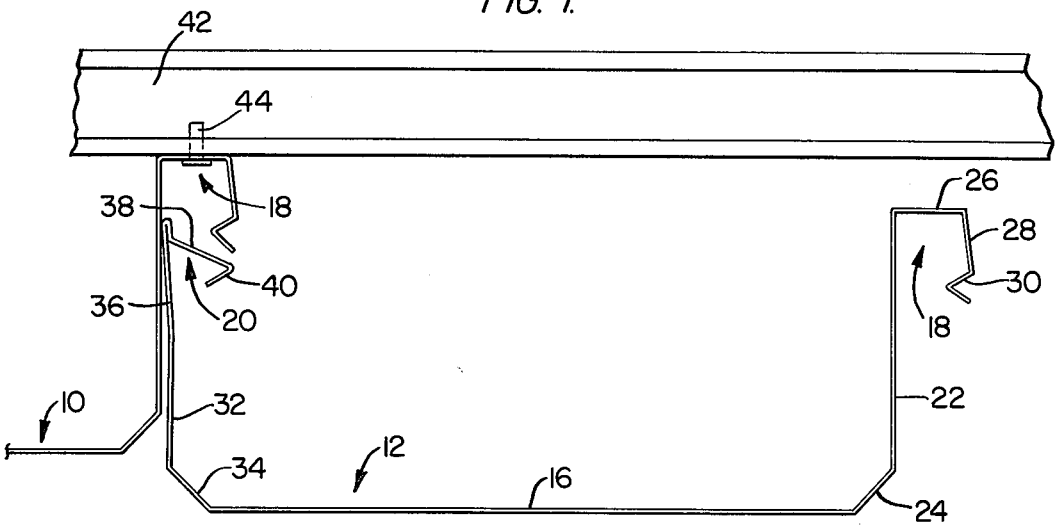
FIG. 1 is an end view of one of the panels illustrating the construction of the interlocking flanges formed at each end thereof, and the position of the panel just before being urged upwardly into engagement with the other panel which has been fastened to the supporting member.
Figure 2:
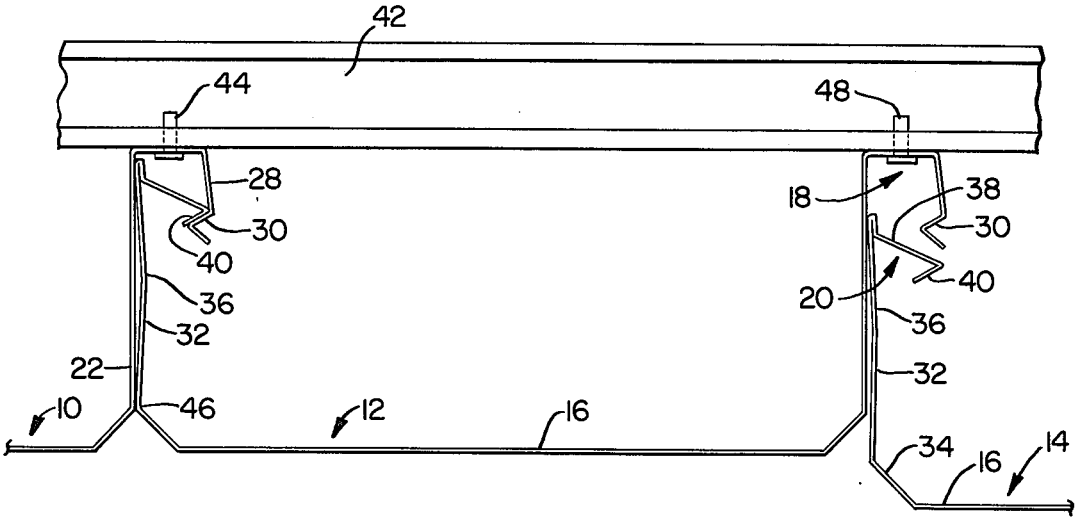
FIG. 2 is an end view of the panel snap-fitted in place, and a portion of another panel ready to be urged upwardly into engagement therewith.
Figure 3:
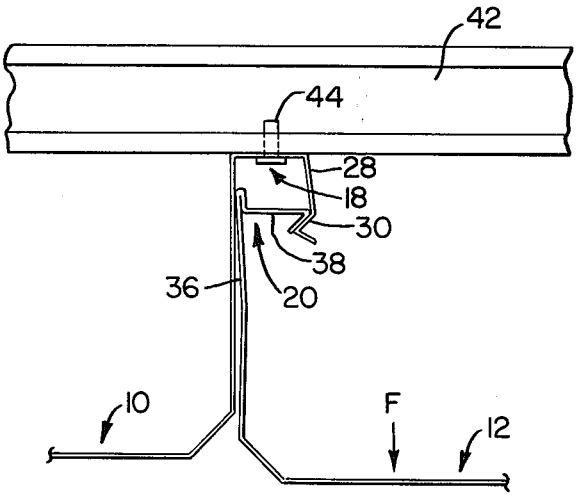
FIG. 3 is an end view of the interlocking flanges of adjacent panels illustrating movement of the diagonal portion of the male flange into tighter engagement with the female flange as pressure is applied to the panel.

The spring action panel interlocking system of the present invention is illustrated in FIGS. 1-2, wherein the reference numerals 10, 12 and 14 designate adjacent panels. The panels 10, 12 may be flat as illustrated in FIGS. 1-3 or curved as designated by the reference numerals 10', 12', in FIG. 4. Each of the panels consists of a wall 16 which may be flat or curved and which ternimates in interlocking flanges 18 and 20. The interlocking flange 18 is provided with a first section 22 that extends outwardly from the wall 16, it being apparent that the section 24 joins the section 22 to the wall 16 such that the section 22 is generally perpendicular to the wall 16. The flange 18 is also provided with a second section 26 that extends outwardly from the section 22 and which is generally perpendicular to the section 22. The flange 18 is also provided with a third section 28 that extends outwardly from the section 26 forming an angle with the section 26 which is approximately 90 degrees. The section 28 terminates in a lip 30. Since each of the panels 10, 12 and 14 is formed of a flexible material, for example, roll formed aluminum, it is apparent that the sections 22, 26 and 28 of the interlocking flange 18 are free to flex, as described hereinafter.

The interlocking flange 20 of each of the panels 10, 12 and 14 is provided with a fourth section 32 which extends outwardly from the wall 16, it being apparent that a section 34 joins the section 32 to the wall 16. A fifth section 36 extends from the section 32 such that the included angle between the sections 32 and 36 is slightly less than 180°. It will be apparent from the foregoing that when the sections 32 and 36 of the male interlocking flange 20 are positioned adjacent the section 22 of the female interlocking flange 18 only portions of the sections 32 and 36 engage the section 22. (See the space between flange sections 22, 32 and 36 in FIG. 2, for example) Each of the interlocking flanges 20 is provided with a sixth section 38 which extends diagonally from the section 36 terminating in a lip 40. It will be apparent from FIG. 2 that when the interlocking flanges 18 and 20 are assembled, the lip 40 of the section 38 engages the point of intersection of the section 28 and lip 30 of the interlocking flange 18.

Installation of the panels will now be described with reference to FIGS. 1–2. It will be apparent from FIG. 1 that the interlocking flange 18 of the panel 10 has been fastened to the overhead beam 42 with the fastener 44 which may, for example, be a self-drilling screw. The installer then positions the interlocking flange 20 of the next panel 12 immediately below the interlocking flange 18 of the mounted panel 10 and pushes upwardly thereon. The pressure of the male interlocking flange 20 against the female interlocking flange 18 causes the section 28 and lip 30 of the interlocking flange 18 to spring outwardly as the diagonal section 38 of the interlocking flange 20 springs downwardly and the sections 32 and 36 of the interlocking flange 20 spring inwardly towards the section 22 of the interlocking flange 18. Eventually, the lip 40 of the male flange 20 passes over the lip 30 of the female flange 18 at which time the sections of the interlocking flanges 18 and 20, as previously described, resume their original position.

It will be apparent that precise alignment of the fronts and rears of adjacent of the panels 10, 12 and 14 is unnecessary since after the interlocking flanges 20 have been inserted within the interlocking flanges 18 adjacent of the panels 10, 12 and 14 may be slided longitudinally relative to each other. Note further that since the sections 32 and 36 of the interlocking flange 20 intersect at an angle slightly less than 180° the result is to reduce the areas of the sections 32 and 36 which engage the section 22 thus reducing friction between the interlocking flanges 18 and 20. Reducing friction, of course, permits ease in longitudinal adjustment of the assembled panels. Moreover, the angular relationship between the sections 32 and 36 of the interlocking flange 20 limits the contact between the sections 32 and 22 to the area generally designated by the reference numeral 46 which results in reducing the tendency of the panels to have a "gap" between the adjacent sections 22 and 32, particularly if one of the sections is bent.

Once the panel 12 is snap-fitted to the panel 10, the interlocking flange 18 of the panel 12 is secured to the overhead beam 42 with the fastener 48, as illustrated in FIG. 2, afterwhich the next panel 14 is secured in place by snapping the male interlocking flange 20 of the panel 14 within the female interlocking flange 18 of the panel 12. It will now be apparent that the fasteners 44 and 48 are hidden from view.

The "fail-safe" feature of the panel interlock of the present invention is illustrated in FIG. 3 wherein the interlocking flanges 18 and 20 of adjacent panels 10 and 12 are shown in locked position. FIG. 3 illustrates how the interlocking flanges 18 and 20 resist unlocking under downward force F despite the fact that only minimal hand pressure is required to lock the interlocking flanges 18 and 20. When force F is applied to the panel 12 the interlocking flanges 18 and 20 resist unlocking as the interlocking flange 20 is forced into even tighter engagement with the interlocking flange 18, eventually resulting in the section 38 of the flange 20 being forced into a position generally perpendicular to the section 36 thereof and the section 28 and lip 30 of the flange 18 being forced outwardly. Thus, the panel 12 cannot unlock from the panel 10 unless and until the flanges 18 and 20 have distorted beyond that position illustrated in FIG. 3.

With the foregoing in mind, certain of the advantages of the spring action panel interlock of the present invention will be described. The adjacent panels 10, 12 and 14 are interlocked with a simple upward linear motion as distinguished from the swing-over motion that is frequently used. That is, during installation it is only necessary to push the panel upwardly into locking relationship with respect to a panel that has already been assembled. The panels 10, 12 and 14 may be attached to the overhead structure 42 with screw-type fasteners 44 and 48 from below, thus avoiding the necessity of working on top of the overhead supporting structure 42. Only easy hand pressure is required for snapping the interlocking flanges 18 and 20 together. While construction time and effort are significantly reduced, the arrangement of the sections of the interlocking flanges of the invention define a "fail-safe" interlock precluding the unlocking of adjacent interlocking flanges under downward pressure. Still further, after the interlocking flanges 18 and 20 are assembled by snapping in place, the adjacent panels 10, 12 and 14 may be easily moved longitudinally by sliding action because friction has been minimized by the angular relationship of the sections 32 and 36 relative to the section 22.

Figure 4:
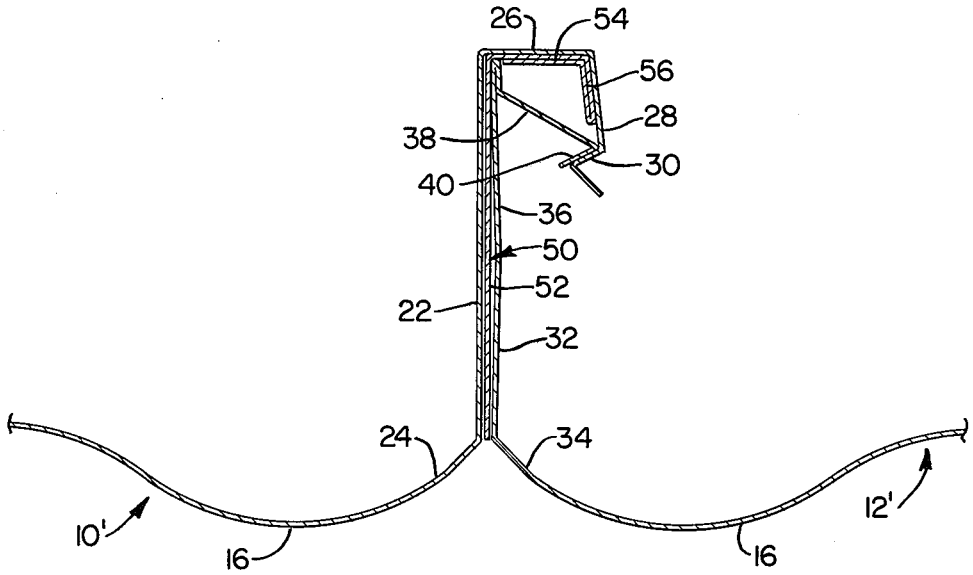
FIG. 4 is a sectional view taken along line 4—4 of FIG. 5 illustrating the interlocking flanges of adjacent panels with a reinforcing member positioned therebetween to increase the load bearing and spanning capability of the assembled panels.
Figure 5:
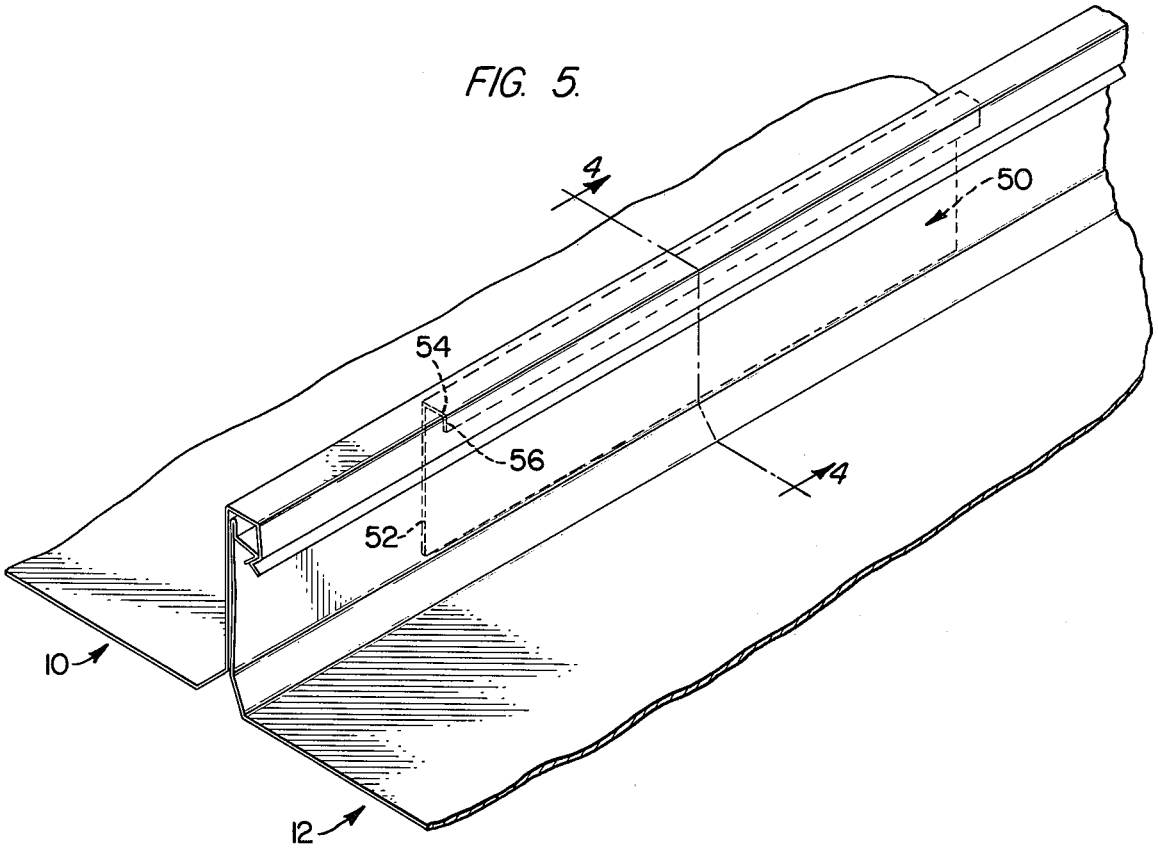
FIG. 5 is a perspective view of the interlocking flanges of adjacent panels with the reinforcing member shown in dotted lines positioned only at the central portion of the panels.

Turning now to FIGS. 4–5, the reference numeral 50 designates generally a reinforcing member that may be positioned within the interlock previously described for the purpose of increasing both the load bearing and spanning capability of the assembled panels 10 and 12. In this connection, it should be noted that flat bottom panels are not as strong under downward loading as structural type panels of comparable gauge metal. This is true because flat panels have considerably less metal under compression in their upper flange areas than do structural panels. Thus, it is necessary to use substantially heavier gauge metal in flat panels than in structural type panels to obtain equivalent loading capacity. But with reinforcing member 50, which is inserted between the interlocking flanges 18 and 20, it is possible to increase the amount of metal that is in a state of compression under loading and thus significantly increase the potential loading and span capability of a given gauge panel, with the additional economic advantage of not having to increase the gauge of metal thoughout the entire panel.

As illustrated in FIG. 4, the reinforcing member 50 consists of a section 52 which is positioned between the sections 32 and 36 of the flange 20 and the section 22 of the flange 18, and a section 54 which extends outwardly from the section 52 and which rests against the section 26 of the flange 18. The section 56 of the reinforcing member 50 extends outwardly from the section 54 and rests in abutting relationship against part of the section 28 of the flange 18. As illustrated in FIG. 4, the sections 54 and 56 may comprise portions of the reinforcing member 50 that are "folded" together.

Moreover, and as illustrated in FIG. 5, it is not necessary to have the reinforcing member 50 extend the entire length of the panels 10 and 12 because under extreme loading the adjacent panels 10 and 12 will fail by compressive buckling of the adjacent flanges 18 and 20 at the center of the span of the panels. Thus, optimum results may be obtained by running the reinforcing member 50 over the center one-half or one-third of the span of the panels 10 and 12.

I claim:

1. A paneling system, comprising a supporting member, a plurality of panels, each of said panels being provided with first and second interlocking flanges that are flexible, said first interlocking flanges having portions extending from said panels to said supporting member engaging said supporting member and then extending away from said supporting member terminating in ends spaced from said portions that extend from said panels, means fastening those portions of said first interlocking flanges that engage said supporting members to said supporting member, said second interlocking flanges having portions extending from said panels which engage only parts of said portions of said first interlocking flanges that extend from said panels and extending to the vicinity of said supporting member and then extending away from said supporting member toward said ends of said first interlocking flanges terminating in ends which engage said ends of said first interlocking flanges, said ends of said second interlocking flanges being spaced from said portions thereof which extend from said panels distances sufficient to force said ends of said first interlocking flanges outwardly until said second interlocking flanges are secured in place within said first interlocking flanges at which time said ends of said first interlocking flanges assume their original positions, and wherein said portions of said first interlocking flanges that extend from said panels to said supporting member are positioned approximately perpendicular to said supporting member, and wherein said portions of said first interlocking flanges that extend away from said supporting member form an angle with those portions of said first interlocking flanges that engage said supporting member that is approximately 90°, and wherein said ends of said first interlocking flanges terminate in lips extending toward said portions of said first interlocking flanges that extend from said panels, and wherein said portions of said second interlocking flanges that extend from said panels and which engage only parts of said portions of said first interlocking flanges are defined by two segments which intersect each other at angles slightly less than 180°, and wherein said portions of said second interlocking flanges which extend toward said ends of said first interlocking flanges are positioned diagonally from the points at which said portions of said first interlocking flanges engage said supporting member and said lips of said first interlocking flanges.

2. A paneling system as in claim 1, further comprising a reinforcing member positioned between said first and second interlocking flanges of adjacent of said panels and extending along a part of the length of said panels.

3. A paneling system as in claim 1, further comprising a reinforcing member positioned between said first and second interlocking flanges of adjacent of said panels, said reinforcing member having a first section positioned between said portions of said first and second interlocking flanges that extend from said panels and a second section engaging that portion of said first interlocking flange that engages said supporting member.

4. A paneling system as in claim 1, wherein said panels are substantially flat.

5. A paneling system as in claim 1, wherein said panels are curved.

6. A panel, comprising a central portion terminating at one end in a female flange and at the other end in a male flange, said female flange having a generally flat portion that extends from said central portion and another portion that terminates in an end that is spaced from said flat portion, said end being provided with a lip extending towards said flat portion, said male flange having a portion extending from said central portion that consists of two segments which intersect each other at an angle slightly less than 180° such that only portions of said two segments of said male flange engage said flat portion of said female flange of an adjacent of said panels and another portion extending toward said central portion for engaging said lip of said female flange of an adjacent of said panels.

7. A panel as in claim 6, wherein said portion of said male flange extending toward said central portion terminates in a lip that extends toward said two segments, said lips of said male and female flanges being complimentary in configuration.

8. In a paneling system having a plurality of interlocking panels wherein each of the panels has a wall terminating in interlocking flanges at each end thereof, the improvement comprising one of said flanges having a first section that extends outwardly from said wall, a substantial portion of said first section being generally perpendicular to said wall, a second section that extends outwardly from said first section and which is generally perpendicular thereto, a third section that extends outwardly from said second section, the angle formed between said second and third sections being approximately 90°, said third section terminating in a lip extending towards said first section, and wherein the other of said flanges has a fourth section that extends outwardly from said wall, a fifth section extending from said fourth section at an angle slightly less than 180° such that only limited portions of said fourth and fifth sections engage said first section of said one of said flanges of an adjacent panel, a sixth section extending from said fifth section and terminating in an end positioned slightly beyond said lip of said third section of said one of said flanges of an adjacent panel such that said end of said sixth section forces said third section outwardly until said end passes said lip.

9. A paneling system, comprising a supporting member, a plurality of panels suspended from said supporting member, each of said panels being provided with first and second interlocking flanges that are flexible, said first interlocking flanges having portions extending from said panels to said supporting member engaging said supporting member and then extending away from said supporting member terminating in ends spaced from said portions that extend from said panels, means fastening those portions of said first interlocking flanges that engage said supporting member to said supporting member, said second interlocking flanges having portions extending from said panels which engage only parts of said portions of said first interlocking flanges that extend from said panels and extending to the vicinity of said supporting member and then extending away from said supporting member toward said ends of said first interlocking flanges terminating in ends which engage said ends of said first interlocking flanges, said ends of said second interlocking flanges being spaced from said portions thereof which extend from said panels sufficient distances to force said ends of said first interlocking flanges outwardly until said second interlocking flanges are secured in place within said first interlocking flanges at which time said ends of said first interlocking flanges assume their original positions.

10. A paneling system as in claim 9, wherein said panels are suspended downwardly from said supporting member, and wherein said portions of said first interlocking flanges extend upwardly from said panels to said supporting member engaging said supporting member and then extend downwardly away from said supporting member and said portions of said second interlocking flanges extend upwardly from said panels engaging parts of said portions of said first interlocking flanges and then extend downwardly away from said supporting member.

11. A paneling system as in claim 9, wherein said ends of said first interlocking flanges of said panels include lips extending inwardly towards said portions of said first flanges which extend from said panels, such that said ends of said second interlocking flanges rest at the juncture of said lips and said portions of said first interlocking flanges extending away from said supporting member.

12. A paneling system as in claim 11, wherein said ends of said second interlocking flanges are provided with lips extending backwardly towards said portions of said second interlocking flanges extending from said panel, said lips of said first and second interlocking flanges engaging each other when said panels are assembled.

13. A paneling system as in claim 9, further comprising a reinforcing member for increasing the loading and spanning capability of said panels positioned between said first and second interlocking flanges of adjacent of said panels and extending along a part of the length of said panels.

14. A paneling system as in claim 13, wherein said reinforcing member includes a first portion that is positioned between said portions of said first and second interlocking flanges extending upwardly from said panels, and a second portion that is adjacent said portion of said first interlocking flanges engaging said supporting member and spaced from said portion of said second interlocking flanges extending downwardly from said supporting member.

* * * * *

UNITED STATES PATENT OFFICE

CERTIFICATE OF CORRECTION

Patent No. 4,091,588 Dated May 30, 1978

Inventor(s) William C. Heirich

It is certified that error appears in the above-identified patent and that said Letters Patent are hereby corrected as shown below:

The term of this patent subsequent to May 30, 1995, has been disclaimed.

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,091,588

DATED : May 30, 1978

INVENTOR(S) : William C. Heirich

It is certified that error appears in the above-identified patent and that said Letters Patent are hereby corrected as shown below:

The Certificate of Correction issued July 11, 1978, has been canceled.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*